US012037865B2

(12) United States Patent
Kozicz et al.

(10) Patent No.: US 12,037,865 B2
(45) Date of Patent: Jul. 16, 2024

(54) APPARATUSES AND METHODS FOR COUPLING ONE OR MORE AUXILIARY LINES TO A SUBSEA WELL CONTROL ASSEMBLY

(71) Applicant: Transocean Sedco Forex Ventures Limited, Grand Cayman (KY)

(72) Inventors: John Kozicz, Houston, TX (US); Craig McCormick, Houston, TX (US)

(73) Assignee: TRANSOCEAN SEDCO FOREX VENTURES LIMITED, George Town (KY)

( * ) Notice: Subject to any disclaimer, the term of this patent is extended or adjusted under 35 U.S.C. 154(b) by 32 days.

(21) Appl. No.: 17/226,679

(22) Filed: Apr. 9, 2021

(65) Prior Publication Data

US 2021/0363850 A1 Nov. 25, 2021

Related U.S. Application Data

(63) Continuation of application No. 15/784,132, filed on Oct. 14, 2017, now Pat. No. 10,975,651.

(60) Provisional application No. 62/408,574, filed on Oct. 14, 2016.

(51) Int. Cl.

| | |
|---|---|
| ***E21B 33/038*** | (2006.01) |
| ***E21B 17/10*** | (2006.01) |
| ***E21B 33/064*** | (2006.01) |
| ***E21B 34/04*** | (2006.01) |
| ***E21B 41/00*** | (2006.01) |
| ***E21B 43/013*** | (2006.01) |

(52) U.S. Cl.

CPC ..... *E21B 33/038* (2013.01); *E21B 17/1035* (2013.01); *E21B 33/064* (2013.01); *E21B 34/04* (2013.01); *E21B 41/0007* (2013.01); *E21B 43/013* (2013.01)

(58) Field of Classification Search

CPC ..... E21B 17/1035
USPC ..... 166/367
See application file for complete search history.

(56) References Cited

U.S. PATENT DOCUMENTS

| | | | | |
|---|---|---|---|---|
| 4,046,191 | A * | 9/1977 | Neath | E21B 21/001 175/25 |
| 4,401,164 | A | 8/1983 | Baugh | |
| 6,474,422 | B2 * | 11/2002 | Schubert | E21B 21/08 175/48 |
| 7,216,714 | B2 | 5/2007 | Reynolds | |
| 7,219,740 | B2 | 5/2007 | Saucier | |
| 7,237,632 | B2 * | 7/2007 | Liao | B62B 5/0046 180/68.5 |
| 8,122,964 | B2 | 2/2012 | Judge et al. | |
| 8,235,123 | B2 * | 8/2012 | Stokka | E21B 33/12 166/387 |

(Continued)

OTHER PUBLICATIONS

Partial Supplementary European Search Report issued by the European Patent Office for Application No. 17860913.7, dated Oct. 5, 2020, 13 pages.

(Continued)

*Primary Examiner* — Matthew Troutman
*Assistant Examiner* — Douglas S Wood
(74) *Attorney, Agent, or Firm* — Panitch Schwarze Belisario & Nadel LLP

(57) ABSTRACT

This disclosure includes apparatuses and methods for coupling one or more auxiliary lines to a subsea well control assembly.

19 Claims, 6 Drawing Sheets

(56) References Cited

U.S. PATENT DOCUMENTS

| | | | | |
|---|---|---|---|---|
| 8,657,013 | B2 * | 2/2014 | Kotrla | E21B 17/01 166/345 |
| 8,746,345 | B2 * | 6/2014 | Kotrla | E21B 33/068 166/347 |
| 8,789,605 | B2 | 7/2014 | Sessions et al. | |
| 8,931,562 | B2 | 1/2015 | Cargol, Jr. et al. | |
| 8,978,774 | B2 * | 3/2015 | Fossli | E21B 21/001 166/347 |
| 9,074,425 | B2 * | 7/2015 | Feasey | E21B 33/085 |
| 9,951,577 | B2 * | 4/2018 | McMiles | E21B 21/001 |
| 10,370,914 | B2 * | 8/2019 | Angstmann | E21B 33/035 |
| 10,975,651 | B2 * | 4/2021 | Kozicz | E21B 34/04 |
| 2007/0107904 | A1 | 5/2007 | Donahue et al. | |
| 2013/0032351 | A1 * | 2/2013 | Smith | E21B 17/06 166/339 |
| 2015/0240585 | A1 | 8/2015 | Mancuso et al. | |
| 2016/0109874 | A1 * | 4/2016 | Holmes | E21B 33/0355 700/275 |
| 2018/0106123 | A1 * | 4/2018 | Kozicz | E21B 41/0007 |

OTHER PUBLICATIONS

Extended European Search Report issued by the European Patent Office for Application No. 17860913.7, Jan. 19, 2021, 10 pages.
International Search Report and Written Opinion in International Application No. PCT/2017/056697, dated Mar. 9, 2018, 11 pages.

* cited by examiner

APPARATUSES AND METHODS FOR COUPLING ONE OR MORE AUXILIARY LINES TO A SUBSEA WELL CONTROL ASSEMBLY

CROSS-REFERENCE TO RELATED APPLICATION

This application is a continuation of U.S. patent application Ser. No. 15/784,132, filed Oct. 14, 2017, entitled "Apparatuses and Methods for Coupling One or More Auxiliary Lines to A Subsea Well Control Assembly," which claims priority to U.S. Provisional Patent Application No. 62/408,574, filed Oct. 14, 2016, entitled "Apparatuses and Methods for Coupling One or More Auxiliary Lines to A Subsea Well Control Assembly," each of which is incorporated herein by reference in its entirety.

BACKGROUND

1. Field of Invention

The present invention relates generally to subsea well control, and more specifically, but not by way of limitation, to apparatuses and methods for coupling one or more auxiliary lines to a subsea well control assembly (e.g., a blowout preventer assembly).

2. Description of Related Art

Risers are used to connect an offshore oil rig (e.g., a platform, drillship, and/or the like) to a subsea well (e.g., during drilling, production, and/or the like). Traditionally, auxiliary lines are coupled to and extend parallel with the riser between the rig and the well. Such auxiliary lines, when coupled to the riser, can add to the weight and complexity to the riser, increasing the time and/or cost associated with deploying the riser.

SUMMARY

Some embodiments of the present subsea interface modules (e.g., that are configured to be coupled to a blowout preventer (BOP) assembly) comprise: a first inlet configured to be coupled to and in fluid communication with a first auxiliary line; a first outlet configured to be coupled to and in fluid communication with one of a booster line, a choke line, a kill line, and a bleed line associated with the BOP assembly; and a second outlet configured to be coupled to and in fluid communication with one other of the booster line, the choke line, the kill line, and the bleed line.

Some modules comprise one or more valves configured to control fluid communication between the first inlet and the first and second outlets, the one or more valves being movable between: a first state in which fluid communication is permitted between the first inlet and the first outlet; and a second state in which fluid communication is permitted between the first inlet and the second outlet. In some modules, when the one or more valves are in the first state, the one or more valves prevent fluid communication between the first inlet and the second outlet. In some modules, when the one or more valves are in the second state, the one or more valves prevent fluid communication between the first inlet and the first outlet.

Some modules comprise a releasable riser connector configured to be coupled to a riser and to permit fluid communication between the riser and a throughbore of the BOP assembly. In some modules, the module is configured such that, when the first auxiliary line is coupled to the first inlet and the riser is coupled to the riser connector: decoupling of the first auxiliary line from the first inlet does not decouple the riser from the riser connector; and/or decoupling of the riser from the riser connector does not decouple the first auxiliary line from the first inlet. In some modules, when the riser is coupled to the riser connector, the riser is rotatable relative to the module. In some modules, the riser is coupled to the riser connector and extends between the BOP assembly and an oil rig; the first auxiliary line is coupled to the first inlet and extends between the BOP assembly and the oil rig; and the first auxiliary line is detached from the riser along a portion of the first auxiliary line, the portion having a length that is greater than or equal to a length of at least 2, 3, 4, 5, 6, 7, 8, 9, or 10 consecutive riser segments of the riser.

In some modules, the first auxiliary line is flexible for a majority of a length of the first auxiliary line that extends between the BOP assembly and the oil rig.

In some modules, the module is configured to be coupled to a lower marine riser package (LMRP) of the BOP assembly.

Some modules comprise an electrical connector configured to be coupled to an auxiliary line to permit electrical communication between the auxiliary line and the BOP assembly.

Some embodiments of the present systems comprise: a riser extending between an oil rig and a BOP assembly; and one or more auxiliary lines extending between the oil rig and the BOP assembly; wherein at least one of the one or more auxiliary lines is detached from the riser along a portion of the auxiliary line, the portion having a length that is greater than or equal to a length of at least 2, 3, 4, 5, 6, 7, 8, 9, or 10 consecutive riser segments of the riser.

In some systems, at least one of the one or more auxiliary lines is flexible for a majority of the length of the auxiliary line that extends between the BOP assembly and the oil rig.

Some systems comprise one or more retaining members, each configured to couple at least one of the one or more auxiliary lines to the riser. In some systems, each of the one or more retaining members comprises: a first clamp configured to be coupled to the riser; a second clamp configured to be coupled to at least one of the one or more auxiliary lines; and a strap extending between the first clamp and the second clamp. In some systems, the strap of each of the one or more retaining members is flexible.

Some embodiments of the present methods comprise: coupling an auxiliary line to a BOP assembly; actuating one or more valves that are in fluid communication between the auxiliary line and the BOP assembly to direct fluid from the auxiliary line to one of a booster line, a choke line, a kill line, and a bleed line associated with the BOP assembly; and actuating the one or more valves to direct fluid from the auxiliary line to one other of the booster line, the choke line, the kill line, and the bleed line.

Some embodiments of the present methods comprise: coupling an auxiliary line to an inlet of a subsea interface module that is coupled to an LMRP of a BOP assembly to permit fluid communication between the auxiliary line and at least one of a booster line, a choke line, a kill line, and a bleed line associated with the BOP assembly; coupling a riser to a releasable riser connector of the subsea interface module to permit fluid communication between the riser and a throughbore of the BOP assembly; and at least one of: decoupling the auxiliary line from the inlet without decoupling the riser from the riser connector; and decoupling the riser from the riser connector without decoupling the auxiliary line from the inlet.

The term "coupled" is defined as connected, although not necessarily directly, and not necessarily mechanically; two items that are "coupled" may be unitary with each other. The terms "a" and "an" are defined as one or more unless this disclosure explicitly requires otherwise. The term "substantially" is defined as largely but not necessarily wholly what is specified (and includes what is specified; e.g., substantially 90 degrees includes 90 degrees and substantially parallel includes parallel), as understood by a person of ordinary skill in the art. In any disclosed embodiment, the term "substantially" may be substituted with "within [a percentage] of" what is specified, where the percentage includes 0.1, 1, 5, and 10 percent.

The phrase "and/or" means and or or. To illustrate, A, B, and/or C includes: A alone, B alone, C alone, a combination of A and B, a combination of A and C, a combination of B and C, or a combination of A, B, and C. In other words, "and/or" operates as an inclusive or.

Further, a device or system that is configured in a certain way is configured in at least that way, but it can also be configured in other ways than those specifically described.

The terms "comprise" (and any form of comprise, such as "comprises" and "comprising"), "have" (and any form of have, such as "has" and "having"), and "include" (and any form of include, such as "includes" and "including") are open-ended linking verbs. As a result, an apparatus that "comprises," "has," or "includes" one or more elements possesses those one or more elements, but is not limited to possessing only those one or more elements. Likewise, a method that "comprises," "has," or "includes," one or more steps possesses those one or more steps, but is not limited to possessing only those one or more steps.

Any embodiment of any of the apparatuses, systems, and methods can consist of or consist essentially of—rather than comprise/have/include—any of the described steps, elements, and/or features. Thus, in any of the claims, the term "consisting of" or "consisting essentially of" can be substituted for any of the open-ended linking verbs recited above, in order to change the scope of a given claim from what it would otherwise be using the open-ended linking verb.

The feature or features of one embodiment may be applied to other embodiments, even though not described or illustrated, unless expressly prohibited by this disclosure or the nature of the embodiments.

Some details associated with the embodiments are described above, and others are described below.

BRIEF DESCRIPTION OF THE DRAWINGS

The following drawings illustrate by way of example and not limitation. For the sake of brevity and clarity, every feature of a given structure is not always labeled in every figure in which that structure appears. Identical reference numbers do not necessarily indicate an identical structure. Rather, the same reference number may be used to indicate a similar feature or a feature with similar functionality, as may non-identical reference numbers. The figures are drawn to scale (unless otherwise noted), meaning the sizes of the depicted elements are accurate relative to each other for at least the embodiment depicted in the figures.

DETAILED DESCRIPTION

Figure 1:
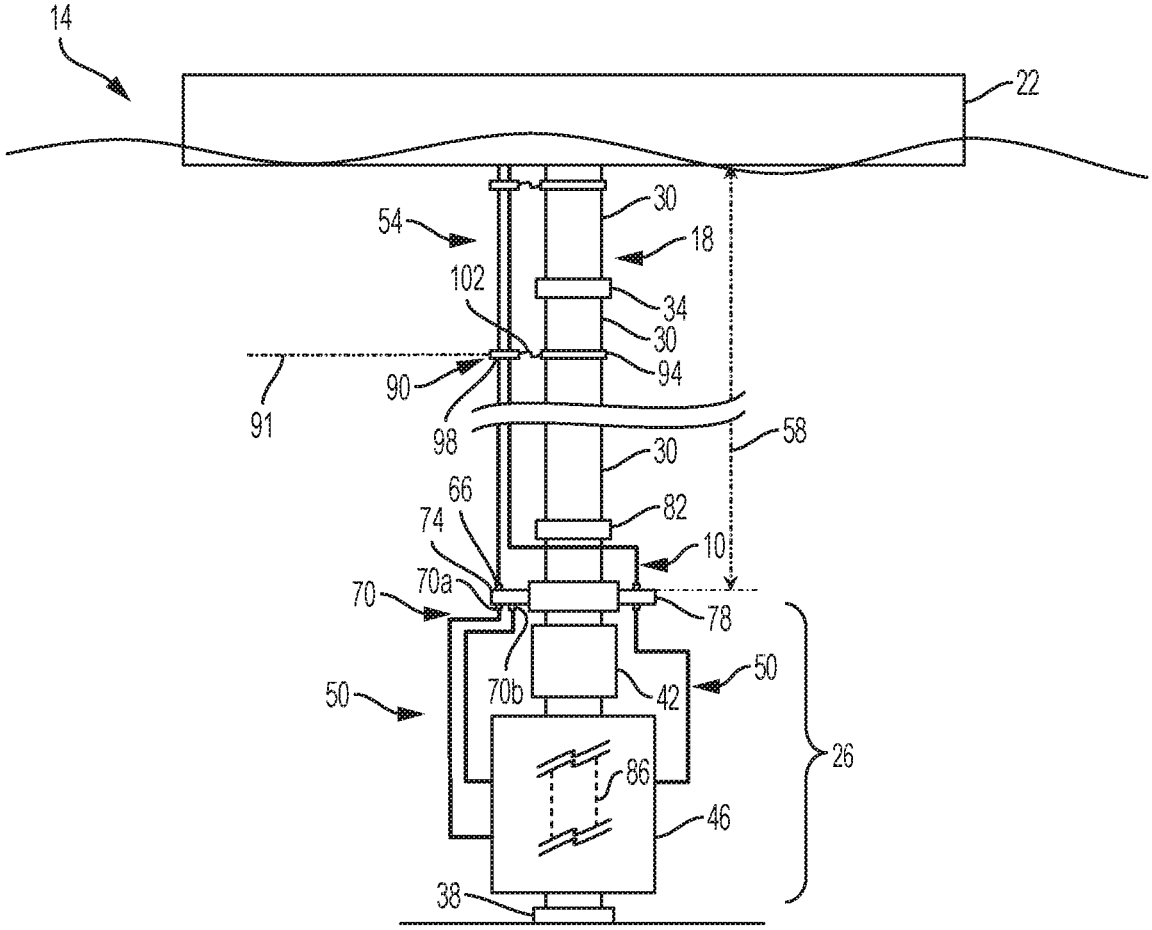
FIG. 1 is a schematic view of a one embodiment of the present systems, including a riser, one or more auxiliary lines, an interface module, and a blowout preventer assembly.

FIG. 1 depicts one embodiment 14 of the present systems. System 14 can include a riser 18 that extends between an offshore oil rig 22 (e.g., a platform, drillship, and/or the like) and a subsea blowout preventer (BOP) assembly 26. Riser 18 can comprise a plurality of riser segments 30 coupled to one another via riser couplings 34. Riser couplings 34 can include flanges, threaded connectors, and/or the like. As another example, connectors that may be suitable for use as riser couplings (e.g., 34) are disclosed in co-pending U.S. Provisional Patent Application, filed on the same day as the present application and entitled "CONNECTOR ASSEMBLIES FOR CONNECTING TUBULARS AND RELATED METHODS," which is hereby incorporated by reference in its entirety.

BOP assembly 26 can be mounted on a wellhead 38. BOP assembly 26 can include a lower marine riser package (LMRP) 42 and a blowout preventer (BOP) stack 46, each of which can include one or more blowout preventers (e.g., ram, annular, and/or the like blowout preventers). System 14 can include one or more lines 50 associated with BOP assembly 26 (e.g., LMRP 42 and/or BOP stack 46 thereof) such as, for example, a choke line, kill line, booster line, bleed line, buoyancy control line, hydraulic line, electrical line, and/or the like. Line(s) 50 can be flexible and/or rigid. In other embodiments, such as those for use during the production phase of a well, a system (e.g., 14) can include a lower riser package and a Christmas tree and one or more lines associated therewith.

Figure 2:
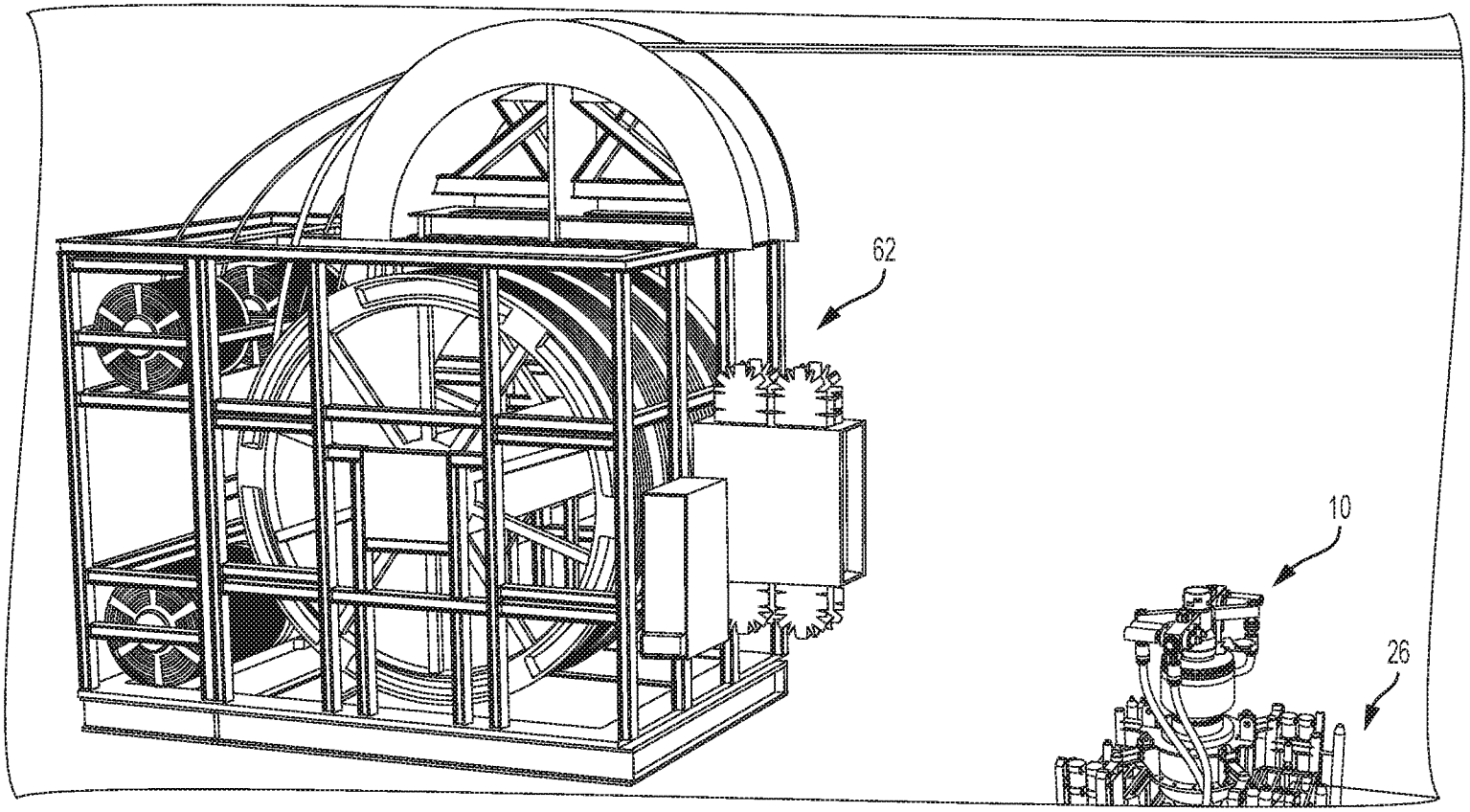
FIG. 2 is a perspective view of the auxiliary line(s) of FIG. 1, shown disposed on a reel.

System 14 can include one or more auxiliary lines 54 configured to extend between oil rig 22 and BOP assembly 26 to permit fluid and/or electrical communication between the oil rig and the BOP assembly (e.g., via coupling with line(s) 50). At least one of auxiliary line(s) 54 can be flexible such that, for example, the auxiliary line can be disposed around and deployed from a reel 62 (FIG. 2). More particularly, at least one of auxiliary line(s) 54 can be flexible for a majority of a length 58 of the auxiliary line that extends between oil rig 22 and BOP assembly 26.

At least one of auxiliary line(s) 54 can include portion(s) along its length 58 that are detached from riser 18 (e.g., across multiple, consecutive riser segments 30). For example, at least one of auxiliary line(s) 54 can be attached to riser 18 at a location (e.g., 91) along the auxiliary line (e.g., at or via oil rig 22, a retaining member 90, or BOP assembly 26), where a distance along the auxiliary line to the next location at which the auxiliary line is attached to the riser is greater than a length of 2, 3, 4, 5, 6, 7, 8, 9, 10 or more riser segments 30, greater than or equal to, or between any two of, 10, 15, 20, 25, 30, 35, 40, 45, 50, 55, 60, 65, 70, 75, 80, 85, 90, or more percent of length 58 of the auxiliary line, and/or the like. Such a detached auxiliary line 54 can, for example, facilitate deployment and/or retrieval of the auxiliary line, reduce loads on the auxiliary line and/or riser 18, and/or the like. Tension of auxiliary line(s) 54 can be controlled via one or more tensioners (e.g., disposed on rig 22), buoyant structures and/or materials coupled to the auxiliary line(s), and/or the like.

System 14 can include one or more auxiliary line retaining members 90, each configured to attach one or more of auxiliary line(s) 54 to riser 18 (e.g., at a riser segment 30 and/or a riser coupling 34). For example, each retaining member 90 can comprise a first clamp 94 configured to be coupled to riser 18, a second clamp 98 configured to be coupled to at least one auxiliary line 54 (e.g., 1, 2, 3, 4, 5, or more auxiliary lines), and a strap 102 extending between the first and second clamps. For at least one retaining member 90, first clamp 94 can be coupled to riser 18 such that the first clamp extends around at least a portion of the riser. The coupling between first clamp 94 of a retaining member 90 and riser 18 can be such that the first clamp is movable (e.g., translatable and/or rotatable) relative to the riser, which can permit movement of auxiliary line(s) 54 that are coupled to the retaining member relative to the riser. In some embodiments, a coupling between a first clamp (e.g., 94) of a retaining member (e.g., 90) and a riser (e.g., 18) can be such that the first clamp is translationally and/or rotationally fixed relative to the riser. For at least one retaining member 90, second clamp 98 can be coupled to an auxiliary line 54 such that the second clamp extends around at least a portion of the auxiliary line. Strap 102 of at least one of retaining member(s) 90 can be rigid and/or flexible. Such retaining member(s) 90 can, for example, mitigate excessive movement, tangling, buckling, and/or the like of auxiliary line(s) 54 that might otherwise be caused by currents, the weight of the auxiliary line(s), and/or the like.

Figure 3B:
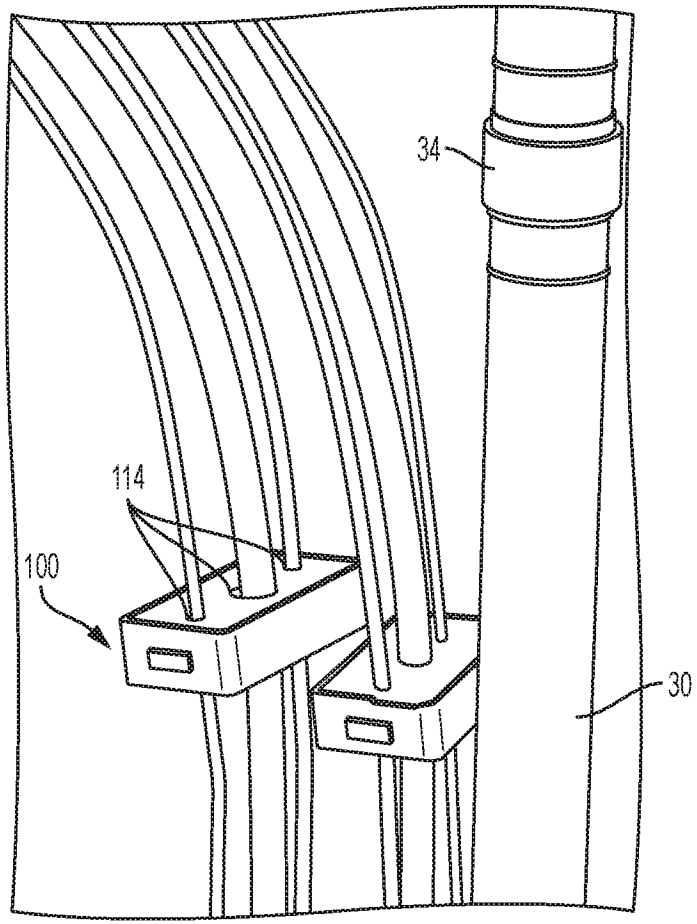
FIGS. 3A and 3B are perspective views of the auxiliary line(s) of FIG. 1, including a plurality of auxiliary line retaining members.
Figure 3A:
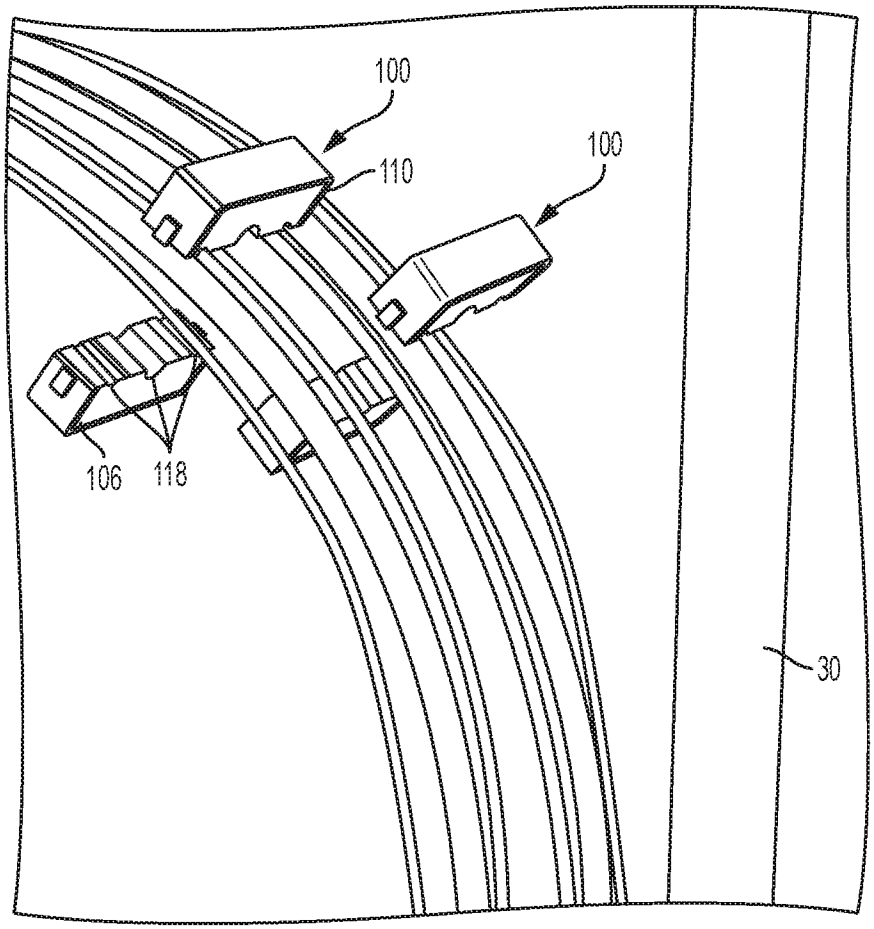
Figure 4:
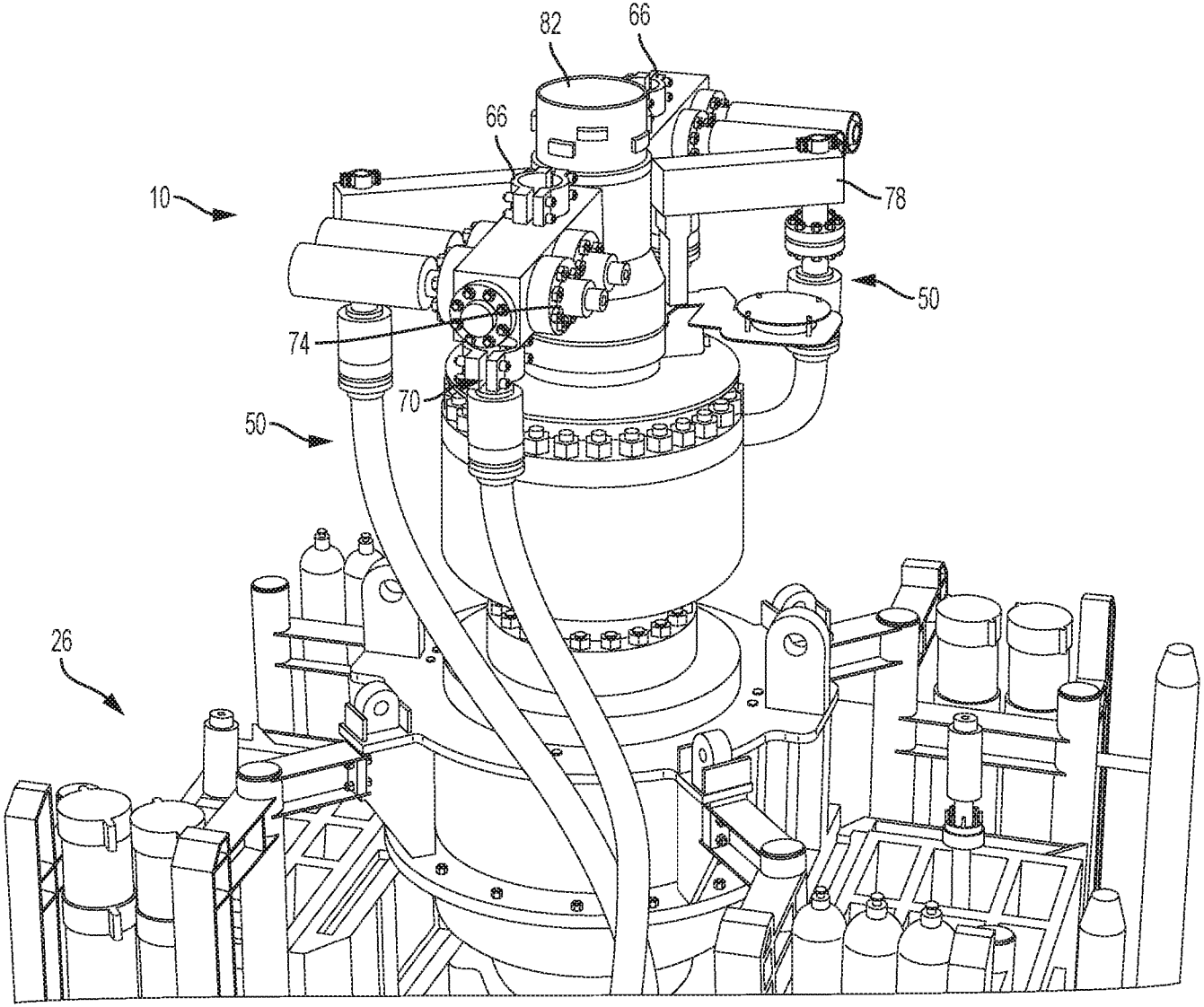
FIG. 4 is a perspective view of the interface module of FIG. 1.
Figure 5:
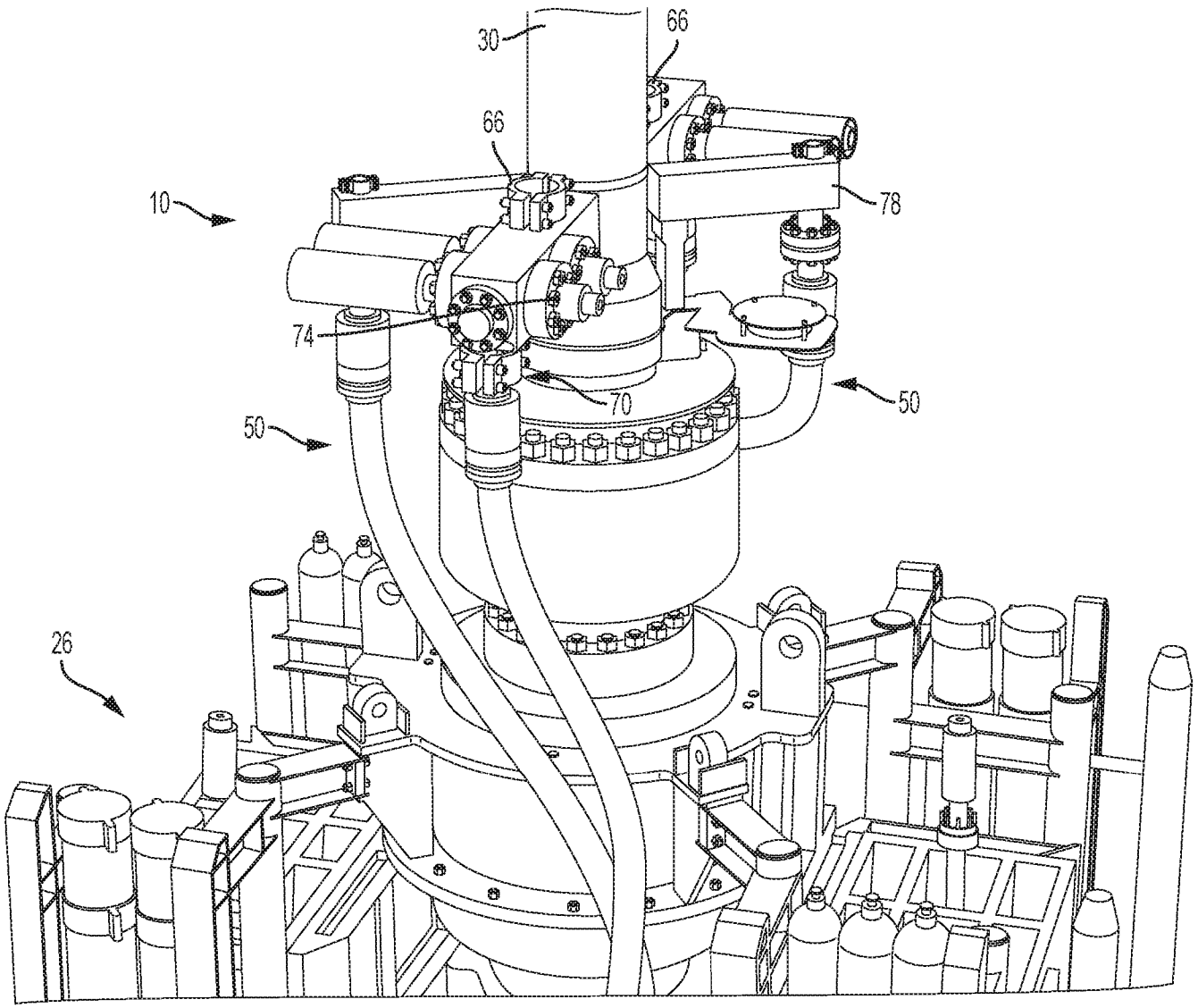
FIG. 5 is a perspective view of the interface module of FIG. 1, shown coupled to the riser of FIG. 1.
Figure 6:
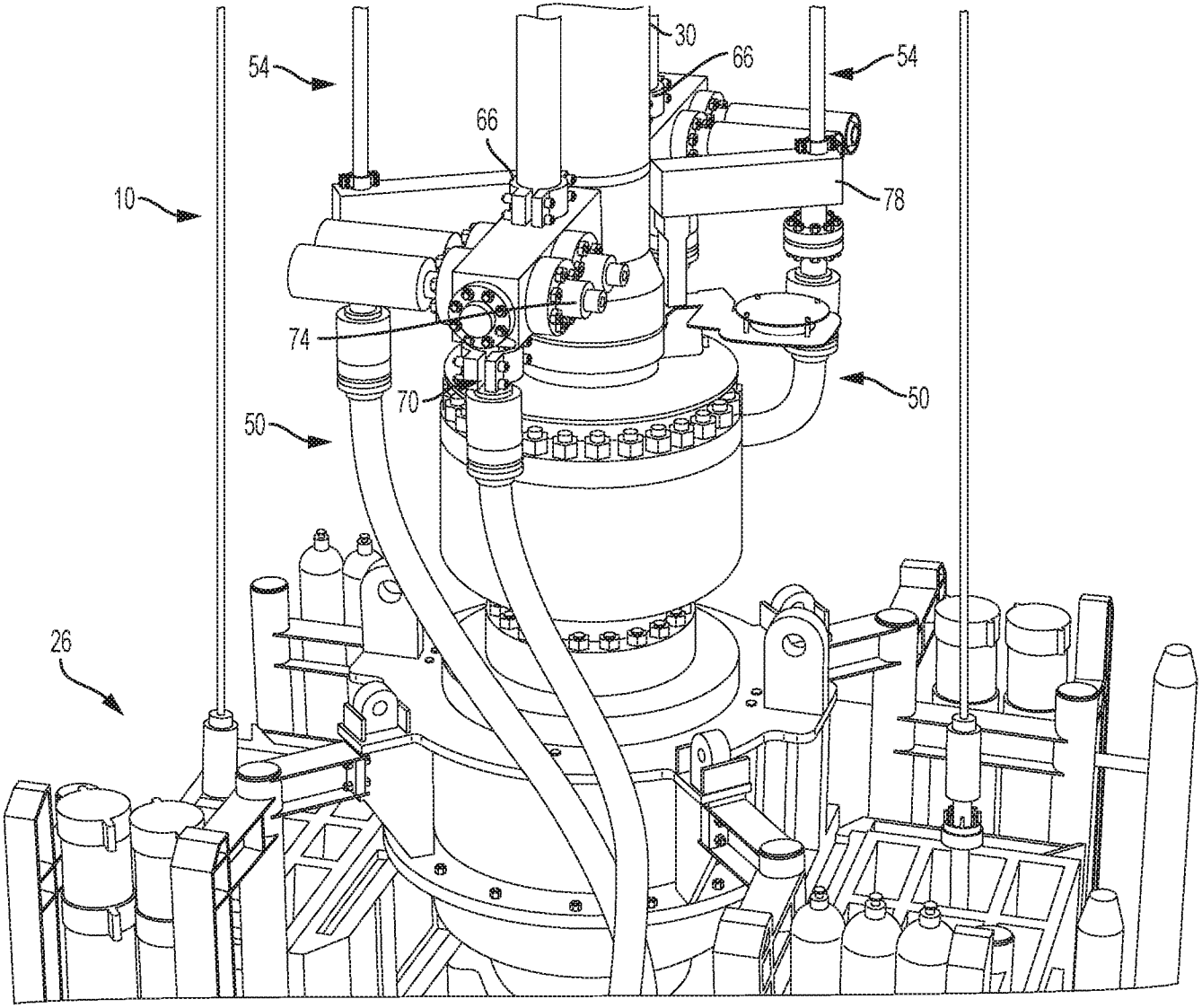
FIG. 6 is a perspective view of the interface module of FIG. 1, shown coupled to the riser and auxiliary line(s) of FIG. 1.

FIGS. 3A and 3B depict auxiliary line retaining members 100 that may be suitable for use in some embodiments (e.g., 14) of the present systems. A retaining member 100 can be used to attach one or more of auxiliary line(s) 54 to riser 18 (e.g., retaining member 100 can serve as a second clamp 98 of a retaining member 90), to attach two or more of the auxiliary lines to one another, and/or the like. For example, at least one retaining member 100 can define one or more openings 114, each configured to receive at least one of auxiliary line(s) 54. More particularly, at least one retaining member 100 can include a first segment 106 and a second segment 110, at least one of which can define one or more slots 118. For at least one retaining member 100, first segment 106 can be movable (e.g., via a pivotal, removable, and/or the like coupling) relative to second segment 110 between an open position and a closed position in which slot(s) 118 define opening(s) 114. For such a retaining member 100, one or more of auxiliary line(s) 54 can be disposed within slot(s) 118 when first segment 106 and second segment 110 are in the open position, and the auxiliary line(s) can be retained within opening(s) 114 of the retaining member by moving the first and second segments to the closed position. At least one retaining member 100 can comprise a buoyant structure and/or material (e.g., foam) such that, when the retaining member is coupled to one or more of auxiliary line(s) 54, the retaining member reduces a submerged weight of the auxiliary line(s).

To illustrate, to deploy system 14, a portion of riser 18 can coupled to BOP assembly 26 on oil rig 22. Auxiliary line(s) 54 can be coupled to BOP assembly 26 (e.g., via interface module 10, described below) on oil rig 22. BOP assembly 26 can be lowered toward wellhead 38 by adding riser segments 30 to riser 18. As BOP assembly 26 is lowered toward wellhead 38, auxiliary line(s) 54 can be unwound from reel 62, and, in some instances, attached to riser 18 (e.g., using retaining member(s) 90). Once BOP assembly 26 reaches wellhead 38, the BOP assembly can be secured to the wellhead.

System 14 can include a subsea interface module 10 configured to couple one or more of auxiliary line(s) 54 and/or riser 18 to BOP assembly 26. For example, interface module 10 can be coupled to LMRP 42 such that the interface module is disposed in fluid and/or electrical communication between the LMRP and auxiliary line(s) 54 and/or riser 18. The coupling between interface module 10 and LMRP 42 can be fixed or removable. In other embodiments, such as those for use during the production phase of a well, an interface module (e.g., 10) can be coupled to a lower riser package.

Interface module 10 can be configured to permit fluid communication between one or more of auxiliary line(s) 54 and BOP assembly 26. For example, interface module 10 can include one or more inlets 66, each configured to be in fluid communication an auxiliary line 54, and one or more outlets 70, each configured to be in fluid communication with a line 50. By permitting fluid communication between an inlet 66 and an outlet 70 (e.g., via valve(s) 74), interface module 10 can permit fluid communication between an auxiliary line 54 coupled to the inlet and a line 50 coupled to the outlet. Interface module 10 can include one or more valves 74 configured to control fluid communication between inlet(s) 66 and outlet(s) 70. Such valve(s) 74 can be configured to permit fluid communication, selectively and/or simultaneously, between any number of inlet(s) 66 and any number of outlet(s) 70 and thus between any number of auxiliary line(s) 54 and any number of line(s) 50. Such valve(s) 74 can comprise any suitable valve, such as, for example, a spool valve, poppet valve, ball valve, and/or the like, in any suitable configuration, such as, for example, two-position two-way (2P2W), 2P3W, 2P4W, 3P4W, and/or the like.

As one example, interface module 10 can include a first inlet (e.g., labeled 66 in FIG. 1) coupled to and in fluid communication with a first auxiliary line (e.g., 54) and first and second outlets (e.g., 70*a* and 70*b*, respectively). The first outlet can be coupled to and in fluid communication with a first line (e.g., 50) (e.g., one of a choke line, kill line, booster line, bleed line, buoyancy control line, hydraulic line, and/or the like), and the second outlet can be coupled to and in fluid communication with a second line (e.g., 50) (e.g., one other of the choke line, kill line, booster line, bleed line, buoyancy control line, hydraulic line, and/or the like). Valve(s) 74 can be movable between a first state in which fluid communication is permitted between the first inlet and the first outlet, and thus the first auxiliary line and the first line, and a second state in which fluid communication is permitted between the first inlet and the second outlet, and thus the first auxiliary line and the second line. In this way, the first auxiliary line can be used to perform more than one function; for example, in one instance (e.g., with valve(s) 74 in the first state), the first auxiliary line can be used as one of a choke line, kill line, booster line, bleed line, buoyancy control line, hydraulic line, and/or the like, and, in another instance (e.g., with valve(s) 74 in the second state), the first auxiliary line can be used as one other of the choke line, kill line, booster line, bleed line, buoyancy control line, hydraulic line, and/or the like. Through such functionality, a number of auxiliary lines (e.g., 54) extending between an oil rig (e.g., 22) and a BOP assembly (e.g., 26) can be reduced.

Interface module 10 can be configured to permit electrical communication between one or more of auxiliary line(s) 50 and BOP assembly 26. For example, interface module 10 can comprise one or more electrical connectors 78, each configured to be coupled to an auxiliary line 54, such as, for example, a mux line, to permit electrical communication between the auxiliary line and BOP assembly 26. At least one of electrical connector(s) 78 can be coupled in electrical communication with at least one of line(s) 50 (e.g., an electrical line). At least one of line(s) 50 can be coupled in electrical communication with a mux control pod.

Riser 18 can be coupled to interface module 10. For example, interface module 10 can comprise a releasable riser connector 82 configured to be coupled to riser 18 and to permit fluid communication between the riser and a throughbore 86 of BOP assembly 26. Riser connector 82 can be configured such that, when riser 18 is coupled to the riser connector, the riser is rotatable relative to interface module 10. Interface module 10 can be configured such that, when riser 18 is coupled to riser connector 82 and one of auxiliary line(s) 54 is coupled to an inlet 66, decoupling of the riser from the riser connector does not decouple the auxiliary line from the inlet and/or decoupling of the auxiliary line from the inlet does not decouple the riser from the riser connector.

Some embodiments of the present methods comprise coupling an auxiliary line (e.g., 54) to a BOP assembly (e.g., 26), actuating one or more valves (e.g., 74) that are in fluid communication between the auxiliary line and the BOP assembly to direct fluid from the auxiliary line to one of a booster line, a choke line, a kill line, and a bleed line (e.g., 50) associated with the BOP assembly, and actuating the one or more valves to direct fluid from the auxiliary line to one other of the booster line, the choke line, the kill line, and the bleed line (e.g., 50).

Some embodiments of the present methods comprise coupling an auxiliary line (e.g., 54) to an inlet (e.g., 66) of a subsea interface module (e.g., 10) that is coupled to an LMRP (e.g., 42) of a BOP assembly (e.g., 26) to permit fluid communication between the auxiliary line and at least one of a booster line, a choke line, a kill line, and a bleed line (e.g., 50) associated with an LMRP (e.g., 42) and/or a BOP stack (e.g., 46) of the BOP assembly, coupling a riser (e.g., 18) to a releasable riser connector (e.g., 82) of the subsea interface module to permit fluid communication between the riser and a throughbore (e.g., 86) of the BOP assembly, and at least one of: (1) decoupling the auxiliary line from the inlet without decoupling the riser from the riser connector; and (2) decoupling the riser from the riser connector without decoupling the auxiliary line from the inlet.

The above specification and examples provide a complete description of the structure and use of illustrative embodiments. Although certain embodiments have been described above with a certain degree of particularity, or with reference to one or more individual embodiments, those skilled in the art could make numerous alterations to the disclosed embodiments without departing from the scope of this invention. As such, the various illustrative embodiments of the methods and systems are not intended to be limited to the particular forms disclosed. Rather, they include all modifications and alternatives falling within the scope of the claims, and embodiments other than the one shown may include some or all of the features of the depicted embodiment. For example, elements may be omitted or combined as a unitary structure, and/or connections may be substituted. Further, where appropriate, aspects of any of the examples described above may be combined with aspects of any of the other examples described to form further examples having comparable or different properties and/or functions, and addressing the same or different problems. Similarly, it will be understood that the benefits and advantages described above may relate to one embodiment or may relate to several embodiments.

The claims are not intended to include, and should not be interpreted to include, means-plus- or step-plus-function limitations, unless such a limitation is explicitly recited in a given claim using the phrase(s) "means for" or "step for," respectively.

The invention claimed is:

1. A subsea interface module configured to be coupled to a BOP assembly, the subsea interface module comprising:

a first inlet configured to be coupled to and in fluid communication with a first auxiliary line and to permit fluid communication between the first auxiliary line and at least one of a booster line, a choke line, a kill line, and a bleed line associated with the BOP assembly; and a releasable riser connector configured to be coupled to a riser and to permit fluid communication between the riser and a throughbore of the BOP assembly;

wherein the module is configured such that, when the first auxiliary line is coupled to the first inlet and the riser is coupled to the riser connector:

decoupling of the first auxiliary line from the first inlet does not decouple the riser from the riser connector; and decoupling of the riser from the riser connector does not decouple the first auxiliary line from the first inlet, wherein the module comprises:

a first outlet in fluid communication with the first inlet and configured to be coupled to and in fluid communication with the first inlet to direct fluid from the first auxiliary line through the first outlet, and then through one of the booster line, the choke line, the kill line, and the bleed line, and then into the BOP assembly, a second outlet in fluid communication with the first inlet and configured to be coupled to and in fluid communication with the first inlet to direct fluid from the first auxiliary line through the second outlet and then through one other of the booster line, the choke line, the kill line, and the bleed line, and then into the BOP assembly; and one or more valves configured to control fluid communication from the first auxiliary line, through the first inlet, to a selected outlet of the first outlet and the second outlet, the one or more valves being movable between:

a first state in which fluid communication is permitted between the first inlet and the first outlet; and a second state in which fluid communication is permitted between the first inlet and the second outlet.

2. The module of claim 1, wherein:

when the one or more valves are in the first state, the one or more valves prevent fluid communication between the first inlet and the second outlet; and when the one or more valves are in the second state, the one or more valves prevent fluid communication between the first inlet and the first outlet.

3. The module of claim 1, wherein, when the riser is coupled to the riser connector, the riser is rotatable relative to the module.

4. The module of claim 1, wherein:

the riser is coupled to the riser connector and extends between the BOP assembly and an oil rig;

the first auxiliary line is coupled to the first inlet and extends between the BOP assembly and the oil rig; and the first auxiliary line is detached from the riser along a portion of the first auxiliary line, the portion having a length that is greater than or equal to a length of at least 2, 3, 4, 5, 6, 7, 8, 9, or 10 consecutive riser segments of the riser.

5. The module of claim 4, wherein the first auxiliary line is flexible for a majority of a length of the first auxiliary line that extends between the BOP assembly and the oil rig.

6. The module of claim 1, wherein the module is configured to be coupled to a lower marine riser package (LMRP) of the BOP assembly.

7. The module of claim 1, comprising an electrical connector configured to be coupled to an auxiliary line to permit electrical communication between the auxiliary line and the BOP assembly.

8. A subsea interface module configured to be coupled to a blowout preventer (BOP) assembly, the subsea interface module comprising:

a first inlet configured to be coupled to and in fluid communication with a first auxiliary line;

a first outlet in fluid communication with the first inlet and configured to be coupled to and in fluid communication with the first inlet to direct fluid from the first auxiliary line through the first outlet, and then through one of a booster line, a choke line, a kill line, and a bleed line associated with the BOP assembly, and then into the BOP assembly;

a second outlet in fluid communication with the first inlet and configured to be coupled to and in fluid communication with the first inlet to direct fluid from the first auxiliary line through the second outlet and then through one other of the booster line, the choke line, the kill line, and the bleed line, and then into the BOP assembly; and one or more valves configured to control fluid communication from the first auxiliary line, through the first inlet, to a selected outlet of the first outlet and the second outlet, the one or more valves being movable between:

a first state in which fluid communication is permitted between the first inlet and the first outlet; and a second state in which fluid communication is permitted between the first inlet and the second outlet.

9. The module of claim 8, wherein:

when the one or more valves are in the first state, the one or more valves prevent fluid communication between the first inlet and the second outlet; and when the one or more valves are in the second state, the one or more valves prevent fluid communication between the first inlet and the first outlet.

10. The module of claim 8, comprising a releasable riser connector configured to be coupled to a riser and to permit fluid communication between the riser and a throughbore of the BOP assembly.

11. The module of claim 10, wherein the module is configured such that, when the first auxiliary line is coupled to the first inlet and the riser is coupled to the riser connector:

decoupling of the first auxiliary line from the first inlet does not decouple the riser from the riser connector; and decoupling of the riser from the riser connector does not decouple the first auxiliary line from the first inlet.

12. The module of claim 1, wherein the first auxiliary line is coupled to the riser via one or more retaining members.

13. The module of claim 12, wherein each of the one or more retaining members comprises:

a first clamp configured to be coupled to the riser;

a second clamp configured to be coupled to at least one of the one or more auxiliary lines; and a strap extending between the first clamp and the second clamp.

14. The module of claim 13, wherein the strap of each of the one or more retaining members is flexible.

15. A method comprising:

coupling a first auxiliary line to a first inlet of a subsea interface module, the subsea interface module having a first outlet in fluid communication with the first inlet and having a second outlet in fluid communication with the first inlet, the subsea interface module being coupled to an TAMP of a BOP assembly to permit fluid communication between the first auxiliary line and at least one of a booster line, a choke line, a kill line, and a bleed line associated with the BOP assembly;

coupling a riser to a releasable riser connector of the subsea interface module to permit fluid communication between the riser and a throughbore of the BOP assembly;

coupling the first outlet to one of the booster line, the choke line, the kill line, and the bleed line associated with the BOP assembly to direct fluid from the first auxiliary line through the first outlet, and then through the one of the booster line, the choke line, the kill line, and the bleed line, and then into the BOP assembly;

coupling the second outlet to one other of the booster line, the choke line, the kill line, and the bleed line associated with the BOP assembly to direct fluid from the first auxiliary line through the second outlet, and then through the one other of the booster line, the choke line, the kill line, and the bleed line, and then into the BOP assembly; and actuating one or more valves to control fluid communication between the first inlet and the first and second outlets.

16. The method of claim 15, further comprising:

actuating one or more valves that are in fluid communication between the first auxiliary line and the BOP assembly to direct fluid from the first auxiliary line to one of a booster line, a choke line, a kill line, and a bleed line associated with the BOP assembly; and actuating the one or more valves to direct fluid from the first auxiliary line to one other of the booster line, the choke line, the kill line, and the bleed line.

17. The method of claim 15, further comprising:

one of the two:

decoupling the first auxiliary line from the first inlet without decoupling the riser from the riser connector; or decoupling the riser from the riser connector without decoupling the first auxiliary line from the first inlet.

18. The method of claim 17, wherein actuating the one or more valves comprises actuating one of:

a first state in which fluid communication is permitted between the first inlet and the first outlet; or a second state in which fluid communication is permitted between the first inlet and the second outlet.

19. The method of claim 18, wherein:

when the one or more valves are in the first state, the one or more valves prevent fluid communication between the first inlet and the second outlet; and when the one or more valves are in the second state, the one or more valves prevent fluid communication between the first inlet and the first outlet.

* * * * *